US012716203B2

(12) United States Patent
Tanaka et al.

(10) Patent No.: US 12,716,203 B2
(45) Date of Patent: Aug. 25, 2026

(54) CONSTRUCTION MACHINE

(71) Applicant: KOBELCO CONSTRUCTION MACHINERY CO., LTD., Hiroshima (JP)

(72) Inventors: Hidenori Tanaka, Hiroshima (JP); Koji Ueda, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 146 days.

(21) Appl. No.: 18/576,666

(22) PCT Filed: Jun. 20, 2022

(86) PCT No.: PCT/JP2022/024540
§ 371 (c)(1),
(2) Date: Jan. 4, 2024

(87) PCT Pub. No.: WO2023/286530
PCT Pub. Date: Jan. 19, 2023

(65) Prior Publication Data

US 2024/0309612 A1 Sep. 19, 2024

(30) Foreign Application Priority Data

Jul. 14, 2021 (JP) ..... 2021-116238

(51) Int. Cl.
*E02F 9/22* (2006.01)

(52) U.S. Cl.
CPC ..... *E02F 9/2285* (2013.01); *E02F 9/2235* (2013.01); *E02F 9/2296* (2013.01)

(58) Field of Classification Search
CPC ..... E02F 9/2285; E02F 9/2235; E02F 9/2296; E02F 9/2228; E02F 9/226; F15B 11/00; F15B 11/02; F15B 11/028; F15B 11/08
See application file for complete search history.

(56) References Cited

U.S. PATENT DOCUMENTS

2004/0231326 A1* 11/2004 Imanishi ..... E02F 9/2235 60/534
2014/0123640 A1* 5/2014 Saotome ..... E02F 9/2292 60/459

(Continued)

FOREIGN PATENT DOCUMENTS

CN 101939550 A 1/2011
JP 2002-339851 A 11/2002

(Continued)

OTHER PUBLICATIONS

English Translation of WO-2009125505-A1 , Shiozaki, Shuji (Year: 2009).*

(Continued)

*Primary Examiner* — Kito R Robinson
*Assistant Examiner* — Kevin Jerome Harvey, II
(74) *Attorney, Agent, or Firm* — Oblon, McClelland, Maier & Neustadt, L.L.P.

(57) ABSTRACT

A construction machine includes a relief valve that opens to limit a pressure of a pump discharge line that is a line between a main pump and a direction switching valve, a back pressure generation mechanism that is disposed on a return line that is a line connected to a tank and generates a back pressure in the return line, and an air bleed line that connects the relief valve and a portion downstream from the back pressure generation mechanism in the return line.

7 Claims, 6 Drawing Sheets

(56) References Cited

U.S. PATENT DOCUMENTS

| | | | | |
|---|---|---|---|---|
| 2014/0196793 | A1* | 7/2014 | Matsuzaki | E02F 9/2267 137/1 |
| 2015/0299987 | A1* | 10/2015 | Ueda | F15B 11/16 414/687 |

FOREIGN PATENT DOCUMENTS

| | | | | |
|---|---|---|---|---|
| JP | 5277201 | B2 * | 8/2013 | |
| JP | 2021050805 | A * | 4/2021 | |
| WO | WO-2009125505 | A1 * | 10/2009 | F04B 1/2042 |

OTHER PUBLICATIONS

English Translation of JP-2021050805-A, Saito, Teppei (Year: 2021).*
English Translation of JP-5277201-B2, Umetsu, Minoru (Year: 2013).*
Extended European Search Report issued Sep. 12, 2024 in European Patent Application No. 22841874.5, 6 pages.
Office Action issued Mar. 26, 2026, in Chinese Patent Application No. 202280048204.5 filed Jun. 20, 2022, (13 pages).
International Search Report issued Aug. 30, 2022 in PCT/JP2022/024540,, filed on Jun. 20, 2022, 2 pages.

* cited by examiner

CONSTRUCTION MACHINE

TECHNICAL FIELD

The present disclosure relates to a construction machine.

BACKGROUND ART

Patent Literature 1 discloses a hydraulic drive device of a construction machine for bleeding air from a pilot pump and a connection pipe thereof. The hydraulic drive device includes an air bleed oil passage connected between a discharge oil passage of the pilot pump and a hydraulic oil tank, and an air bleed valve interposed in the air bleed oil passage. The air bleed valve blocks the air bleed oil passage in a case where a lock lever is at an unlocked position, and makes communication of the air bleed oil passage in a case where the lock lever is at a locked position.

In the hydraulic drive device of Patent Literature 1, even if air bleed can be performed on the pilot pump and the connection pipe thereof, air building up in a relief valve disposed in a hydraulic circuit cannot be effectively discharged. Specifically, in general, the hydraulic circuit in the construction machine includes a relief valve that opens to limit a pressure of a pump discharge line that is a line between a hydraulic pump and a direction switching valve. This relief valve has a structure where air easily builds up. Therefore, it is desirable to effectively discharge the air building up in the relief valve of the hydraulic circuit from the relief valve.

CITATION LIST

Patent Literature

Patent Literature 1: Japanese Patent No. 5277201

SUMMARY OF INVENTION

The present disclosure has been made in view of the above problems, and an object of the present disclosure is to provide a construction machine capable of effectively discharging air building up in a relief valve of a hydraulic circuit from the relief valve.

A construction machine to be provided includes a tank that stores hydraulic oil, a main pump that is a hydraulic pump that discharges the hydraulic oil sucked from the tank, a hydraulic actuator that receives supply of the hydraulic oil from the main pump to operate, a direction switching valve that controls supply and discharge of the hydraulic oil between the main pump and the hydraulic actuator, a relief valve that opens to limit a pressure of a pump discharge line that is a line between the main pump and the direction switching valve, a back pressure generation mechanism that is disposed on a return line as a line connected to the tank and generates a back pressure in the return line, and an air bleed line that connects the relief valve and a portion downstream from the back pressure generation mechanism in the return line.

DESCRIPTION OF EMBODIMENT

Figure 1:
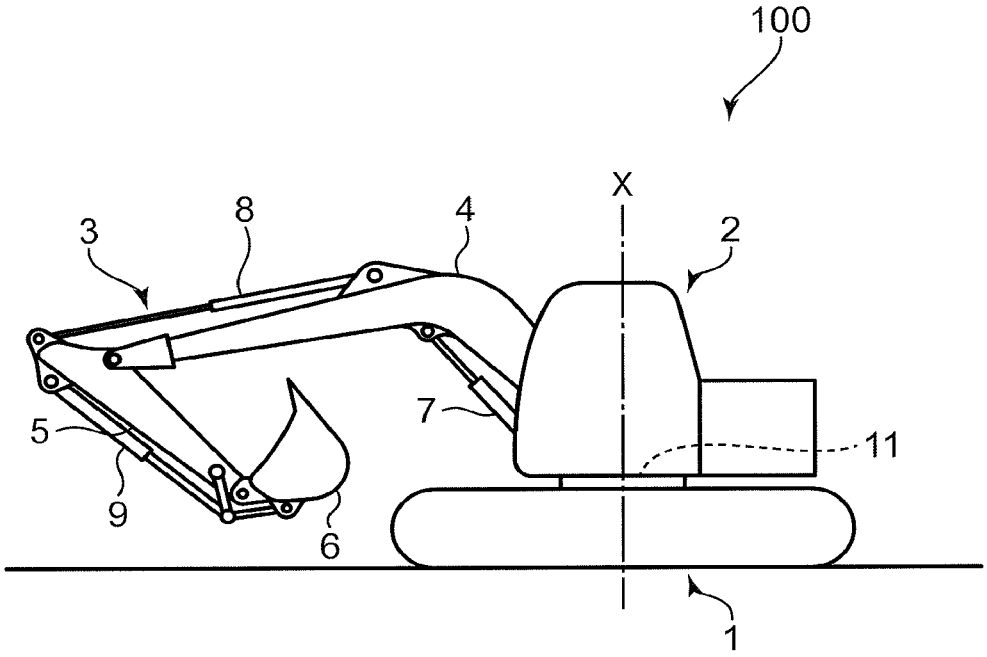
FIG. 1 is a side view illustrating a construction machine according to an embodiment of the present disclosure.

An embodiment of the present disclosure will be described with reference to the drawings. FIG. 1 is a side view illustrating a hydraulic excavator 100 according to the embodiment. The hydraulic excavator 100 is an example of a construction machine.

As illustrated in FIG. 1, the hydraulic excavator 100 includes a lower travelling body 1 capable of traveling on a ground, an upper slewing body 2 supported to the lower travelling body 1 to be slewable about a slewing center axis X facing a vertical direction, and a work device 3 supported to the upper slewing body 2. The lower travelling body 1 and the upper slewing body 2 are examples of a machine body.

The lower travelling body 1 includes a pair of crawler travelling devices and a lower frame connecting these travelling devices. The upper slewing body 2 includes an upper frame slewably supported to the lower frame, a cabin supported to a front portion of the upper frame, and a counterweight supported to a rear portion of the upper frame. In the present embodiment, the work device 3 includes a boom 4, an arm 5, and a bucket 6.

The boom 4 is supported to the upper frame to be raised and lowered with respect to the upper frame of the upper slewing body 2. The arm 5 is supported to the boom 4 to be rotatable with respect to the boom 4. The bucket 6 is supported to the arm 5 to rotationally move with respect to the arm 5.

The hydraulic excavator 100 further includes a plurality of hydraulic actuators for hydraulically moving the work device 3 and the upper slewing body 2. The plurality of hydraulic actuators includes a boom cylinder 7, an arm cylinder 8, a bucket cylinder 9, and a slewing motor 11.

Figure 2:
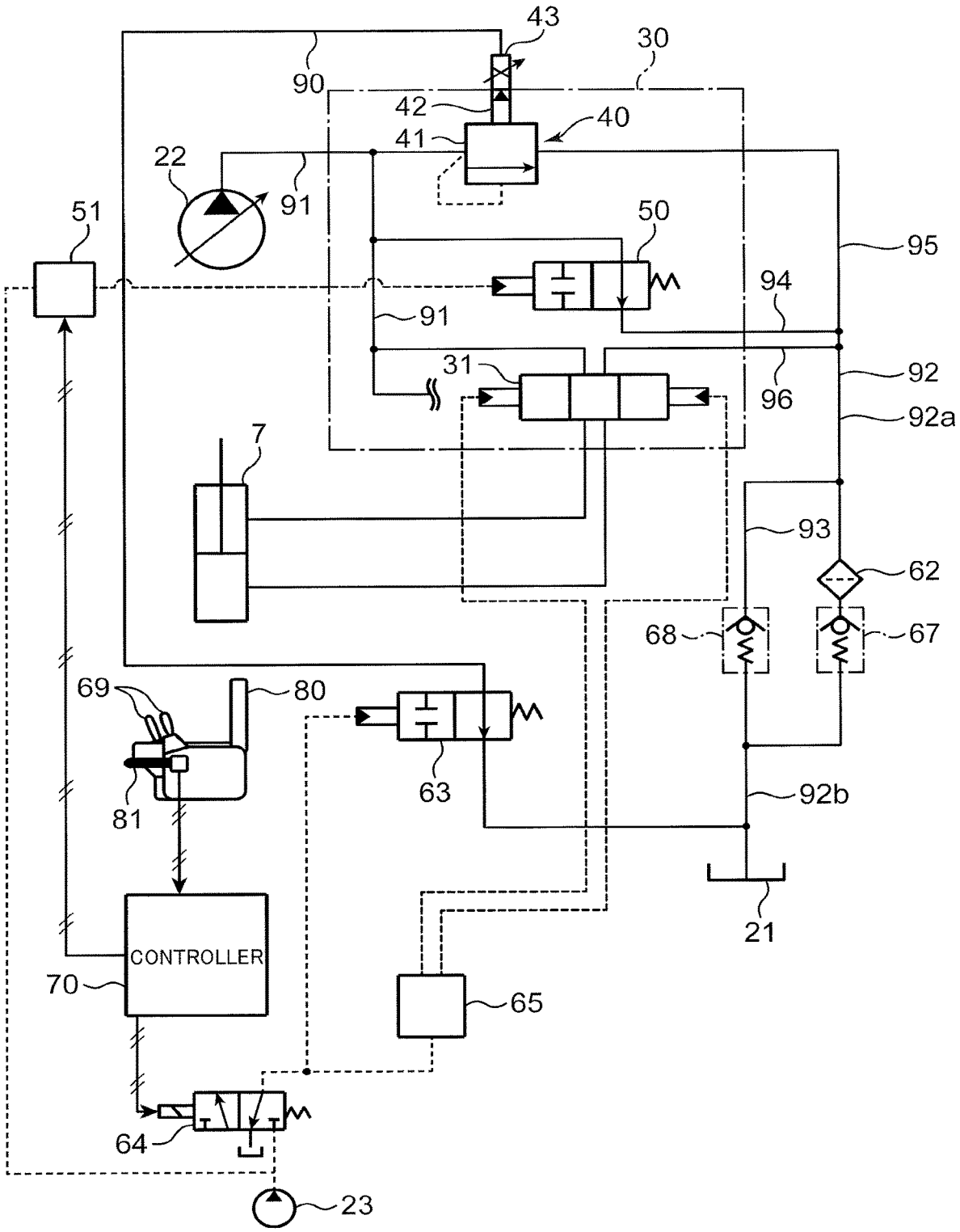
FIG. 2 is a diagram illustrating a hydraulic circuit of the construction machine according to the embodiment and devices related thereto.

FIG. 2 is a diagram illustrating a hydraulic circuit of the hydraulic excavator 100 according to the embodiment and devices related thereto. As illustrated in FIG. 2, the hydraulic excavator 100 further includes a tank 21, a plurality of main pumps including a main pump 22, a pilot pump 23, a control valve unit 30, a boost check valve 67 (check valve), a bypass check valve 68 (check valve), a filter 62, a plurality of operation levers 69, a plurality of pilot valves 65, a lever lock 81, a lever lock valve 64, an unloading electromagnetic proportional valve 51, an air bleed switching valve 63, and a controller 70.

The controller 70 includes a central processing unit (CPU), a memory, and the like. The controller 70 includes a command output unit that outputs command signals to the lever lock valve 64, the unloading electromagnetic proportional valve 51, and the like, and the command output unit is achieved by the CPU executing a control program.

The control valve unit 30 includes a control valve main body, a relief valve 40, and an unloading valve 50. The control valve main body includes a plurality of direction switching valves. The plurality of direction switching valves includes a boom cylinder direction switching valve 31, an arm cylinder direction switching valve, a bucket cylinder direction switching valve, and a slowing motor direction switching valve. The control valve unit 30 includes the plurality of direction switching valves and various functional components including the relief valve 40 and the unloading valve 50, and is configured so that these valves are integrated. That is, the relief valve 40 and the unloading valve 50 are mounted on the control valve main body.

The relief valve 40 is an electromagnetic relief valve capable of changing a set pressure. The relief valve 40 is interposed between the main pump 22 and the tank 21. The relief valve 40 closes until a pressure of a pump discharge line 91, which is a line between the main pump 22 and the control valve main body including the boom cylinder direction switching valve 31, rises to the set pressure, and opens when the pressure reaches the set pressure to limit the pressure of the pump discharge line 91 to the set pressure or less. The relief valve 40 is disposed on a relief line 95 branched from the pump discharge line 91. The relief line 95 is connected to a return line 92. The return line 92 is a line connected to the tank 21.

The relief valve 40 includes a relief valve main body 41 and a pressure adjustment mechanism unit 42 (pressure adjustment unit 42) having a solenoid. The set pressure of the relief valve main body 41 changes in response to a set pressure command signal input from the controller 70 to the solenoid of the pressure adjustment mechanism unit 42. Therefore, the upper limit value of the pressure of the pump discharge line 91 can be varied by changing the set pressure command signal (changing the set pressure). The relief valve 40 has an air bleed port 43. The air bleed port 43 is formed in, for example, the pressure adjustment mechanism unit 42.

In a method for mounting the relief valve 40 on the control valve main body, a mounting position and a mounting orientation are restricted by a position and an orientation of the control valve main body when the control valve unit 30 is mounted on the upper slewing body 2. Therefore, a degree of freedom of disposition of the relief valve 40 is small when the control valve unit 30 is mounted on the upper slewing body 2. Further, the relief valve 40 has a structure where air is likely to build up therein. In particular, the pressure adjustment mechanism unit 42 of the relief valve 40 has a structure where air is likely to build up. Therefore, in a case where the relief valve 40 is disposed in the upper slewing body 2 at an attitude such that the pressure adjustment mechanism unit 42 is positioned above the relief valve main body 41, air is particularly likely to build up in the pressure adjustment mechanism unit 42 of the relief valve 40.

The unloading valve 50 is a valve for running hydraulic oil discharged from the main pump 22 to the return line 92 without supplying the hydraulic oil to the plurality of hydraulic actuators including the boom cylinder 7. The unloading valve 50 is disposed on an unloading line 94 branched from the pump discharge line 91 and connected to the return line 92.

The unloading valve 50 has a pilot port. The unloading valve 50 opens so as to communicate the main pump 22 and the return line 92 via the unloading line 94 in a state where the pilot pressure is not applied to the pilot port, and prevents the communication between the main pump 22 and the return line 92 via the unloading line 94 in a state where a predetermined pilot pressure is applied to the pilot port. The unloading valve 50 changes the opening degree based on the pilot pressure input to the pilot port. The controller 70 outputs a command signal to the unloading electromagnetic proportional valve 51, and the unloading electromagnetic proportional valve 51 outputs the pilot pressure corresponding to the command signal to the pilot port of the unloading valve 50. As a result, the opening degree of the unloading valve 50 is adjusted to a magnitude based on the pilot pressure.

In FIG. 2, only the main pump 22 among the plurality of main pumps is illustrated, and illustration of the other main pumps is omitted. Further, in FIG. 2, only the boom cylinder 7 among the plurality of hydraulic actuators is illustrated, and illustration of the other hydraulic actuators is omitted. Further, in FIG. 2, only the boom cylinder direction switching valve 31 among the plurality of direction switching valves is illustrated, and illustration of the other direction switching valves is omitted.

The tank 21 stores hydraulic oil. Each of the plurality of main pumps including the main pump 22 is a hydraulic pump that is driven by an engine, not illustrated, and discharges the hydraulic oil sucked from the tank 21. Each of the plurality of main pumps supplies the hydraulic oil to at least one hydraulic actuator among the plurality of hydraulic actuators. In the present embodiment, the main pump 22 is a variable displacement type hydraulic pump, but may be a fixed displacement type hydraulic pump. The pilot pump 23 is a hydraulic pump that is driven by the engine, not illustrated, and discharges the hydraulic oil sucked from the tank 21. The pilot pump 23 supplies the pilot pressure of the hydraulic oil to the pilot ports of the plurality of direction switching valves, the pilot port of the unloading valve 50, the plurality of pilot valves, and the like. When the engine is started, each of the plurality of main pumps and the pilot pump 23 discharge hydraulic oil.

The boom cylinder 7 is a hydraulic cylinder that extends and contracts upon reception of supply of the hydraulic oil discharged from the main pump 22. The boom cylinder 7 is attached to the upper slewing body 2 and the boom 4 such that the boom 4 is raised and lowered with respect to the upper slewing body 2 as the boom cylinder 7 extends and contracts.

The arm cylinder 8 is a hydraulic cylinder that extends and contracts upon reception of supply of the hydraulic oil discharged from any of the plurality of main pumps. The arm cylinder 8 is attached to the boom 4 and the arm 5 such that the arm 5 rotationally moves with respect to the boom 4 as the arm cylinder 8 extends and contracts.

The bucket cylinder 9 is a hydraulic cylinder that extends and contracts upon reception of supply of the hydraulic oil discharged from any of the plurality of main pumps. The bucket cylinder 9 is attached to the arm 5 and the bucket 6 such that the bucket 6 rotationally moves with respect to the arm 5 as the bucket cylinder 9 extends and contracts.

The slewing motor 11 is a hydraulic motor for hydraulically slewing the upper slewing body 2 with respect to the lower travelling body 1. The slewing motor 11 has an output shaft, and the output shaft is connected to the upper frame of the upper slewing body 2 via a speed reducer, not illustrated. The slewing motor 11 operates so that the output shaft rotates in a direction corresponding to a direction of supply of the hydraulic oil discharged from any of the plurality of main pumps upon reception of the supply, and thus the upper slowing body 2 can be slewed in each of a left slewing direction and a right slewing direction.

The boom cylinder direction switching valve 31 controls supply and discharge of the hydraulic oil to and from the boom cylinder 7. Specifically, the boom cylinder direction switching valve 31 has a pair of pilot ports. The boom cylinder direction switching valve 31 can switch among a neutral position, a boom raising position for guiding the hydraulic oil from the main pump 22 to a head-side chamber of the boom cylinder 7, and a boom lowering position for guiding the hydraulic oil from the main pump 22 to a rod-side chamber of the boom cylinder 7.

When the pilot pressure is applied to none of the pair of pilot ports, the boom cylinder direction switching valve 31 is maintained at the neutral position to shut off between the main pump 22 and the boom cylinder 7. The boom cylinder direction switching valve 31 is switched to the boom raising position to allow the supply of the hydraulic oil from the main pump 22 to the head-side chamber of the boom cylinder 7 when the pilot pressure is applied to one of the pair of pilot ports, and is switched to the boom lowering position to allow the supply of the hydraulic oil from the main pump 22 to the rod-side chamber of the boom cylinder 7 when the pilot pressure is applied to the other one of the pair of pilot ports.

The hydraulic oil discharged from the boom cylinder 7 and passing through the boom cylinder direction switching valve 31 is discharged to a discharge line 96. The discharge line 96 is connected to the return line 92. Therefore, the hydraulic oil discharged from the boom cylinder 7 returns to the tank 21 through the return line 92.

The arm cylinder direction switching valve controls supply and discharge of hydraulic oil to and from the arm cylinder 8, the bucket cylinder direction switching valve controls supply and discharge of hydraulic oil to and from the bucket cylinder 9, and the slewing motor direction switching valve controls supply and discharge of hydraulic oil to and from the slewing motor 11. The basic structures and functions of the arm cylinder direction switching valve, the bucket cylinder direction switching valve, and the slewing motor direction switching valve are similar to those of the boom cylinder direction switching valve 31, and thus detailed description thereof will be omitted.

The boost check valve 67 is a back pressure holding valve (back pressure valve) that generates a pressure (back pressure) set in advance in the return line 92. The boost check valve 67 is disposed on the return line 92, and opens when the pressure of the return line 92 is a predetermined pressure or more, and the hydraulic oil flows out to the tank 21.

The filter 62 is for filtering the hydraulic oil before returning to the tank 21 in the return line 92. The filter 62 is disposed, for example, upstream from the boost check valve 67 in the return line 92.

The bypass check valve 68 is a bypass valve that is provided in parallel with the boost check valve 67 and opens when its pressure becomes higher than that of the boost check valve 67, and bypasses and causes the hydraulic oil to flow out to the tank 21 in a case where clogging occurs in the filter 62. The bypass check valve 68 is disposed on a bypass line 93 branching from the return line 92.

The plurality of operation levers 69 includes a right operation lever and a left operation lever disposed on the left and right of a driver's seat 80 (see FIG. 2) on which an operator sits. For example, the right operation lever may function as a boom operation lever when being operated in a front-rear direction, and may function as a bucket operation lever when being operated in a left-right direction. The left operation lever may function as an arm operation lever when being operated in a front-rear direction, and may function as a slewing operation lever when being operated in a left-right direction. The functions of the left and right operation levers are not limited to the above specific examples, and may be configured to be arbitrarily changeable by an operator's instruction, for example.

An operation for operating the boom cylinder 7 is given to the boom operation lever by an operator. An operation for operating the arm cylinder 8 is given to the arm operation lever by an operator. An operation for operating the bucket cylinder 9 is given to the bucket operation lever by an operator. An operation for operating the slewing motor 11 is given to the slewing operation lever by an operator.

The plurality of pilot valves 65 includes a boom operation pilot valve, an arm operation pilot valve, a bucket operation pilot valve, and a slewing operation pilot valve. The boom operation pilot valve is interposed between the pilot pump 23 and the boom cylinder direction switching valve 31, and controls the operation of the boom cylinder direction switching valve 31. The boom operation pilot valve operates to supply the pilot pressure based on the operation amount of the boom operation lever to a pilot port corresponding to the operation direction of the boom operation lever among the pair of pilot ports of the boom cylinder direction switching valve 31. As a result, a flow rate and a supply direction of hydraulic oil to be supplied to the boom cylinder 7 are adjusted.

The arm operation pilot valve is interposed between the pilot pump 23 and the arm cylinder direction switching valve, and controls the operation of the arm cylinder direction switching valve. The bucket operation pilot valve is interposed between the pilot pump 23 and the bucket cylinder direction switching valve, and controls the operation of the bucket cylinder direction switching valve. The slewing operation pilot valve is interposed between the pilot pump 23 and the slewing motor direction switching valve, and controls the operation of the slewing motor direction switching valve. The basic structures and functions of the arm operation pilot valve, the bucket operation pilot valve, and the slewing operation pilot valve are similar to those of the boom operation pilot valve, and thus detailed description thereof will be omitted.

The lever lock 81 includes an operation member capable of switching between a valid state (unlocked state) and invalid state (locked state) of the operations of the plurality of operation levers 69. The lever lock 81 is an example of a locking mechanism (locking switch). The lever lock 81 receives an operation for switching the state of the hydraulic circuit between an unlocked state where the operations of the cylinders 7, 8, and 9 and the slewing motor 11 are permitted in response to the operations given to the plurality of operation levers 69 and a locked state where the operations of the cylinders 7, 8, and 9 and the slewing motor 11 are prevented in response to the operations given to the plurality of operation levers 69.

The operation member of the lever lock 81 is disposed, for example, on the left side of the driver's seat 80, and is configured to be capable of being raised and lowered by an operator, for example, when the operator enters or leaves the cabin. The lever lock 81 inputs a locking signal, which is an electric signal corresponding to the locked state, to the controller 70 when the operation member of the lever lock 81 is disposed at the locked position. As a result, the operations of the plurality of operation levers 69 is invalidated. On the other hand, when the operation member of the lever lock 81 is disposed at the unlocked position, the lever lock 81 inputs an unlocking signal, which is an electric signal corresponding to the unlocked state, to the controller 70. As a result, the operations of the plurality of operation levers 69 is validated.

The lever lock valve 64 is an electromagnetic valve having a solenoid that receives a command signal output from the controller 70, and is an electromagnetic valve that receives the command signal input from the controller 70 and opens so that hydraulic oil from the pilot pump 23 is supplied to the air bleed switching valve 63 and the plurality of pilot valves 65. When the lever lock 81 inputs the unlocking signal to the controller 70, the controller 70 inputs a command signal to the solenoid of the lever lock valve 64. As a result, the lever lock valve 64 opens, and the hydraulic oil from the pilot pump 23 is supplied to the air bleed switching valve 63 and the plurality of pilot valves 65.

The hydraulic circuit of the hydraulic excavator 100 according to the present embodiment includes an air bleed line 90 that connects the pressure adjustment mechanism unit 42 of the relief valve 40 and the return line 92. The air bleed line 90 is a pipe for collecting air building up in the relief valve 40 together with hydraulic oil to the tank 21 through the air bleed line 90.

An upstream end of the air bleed line 90 is connected to the air bleed port 43 of the relief valve 40, and a downstream end of the air bleed line 90 is connected to a portion of the return line 92 between the boost check valve 67 and the tank 21. Further, the downstream end of the air bleed line 90 is connected to a portion of the return line 92, the portion being on the tank 21 side relative to the bypass line 93.

When the main pump 22 is discharging the hydraulic oil, the pressure of a portion 92*a* upstream from the boost check valve 67 in the return line 92 is higher than the pressure of a portion 92*b* of the return line 92 downstream from the boost check valve 67. The relief line 95 is connected to the portion 92*a* upstream on the return line 92. Therefore, when the main pump 22 is discharging the hydraulic oil, the pressure in the relief valve 40 disposed on the relief line 95 is higher than the pressure at the portion 92*b* downstream on the return line 92. By using such a pressure difference between the pressures in the relief valve 40 and the pressure at the portion 92*b* downstream on the return line 92, the hydraulic oil containing air building up in the relief valve 40 flows out from the air bleed port 43 of the relief valve 40 to the air bleed line 90, flows toward the tank 21 through the air bleed line 90, and is collected in the tank 21. As a result, the air building up in the relief valve 40 can be bled.

The air bleed switching valve 63 is a valve capable of switching between an allowed state where the hydraulic oil from the relief valve 40 is allowed to flow to the tank 21 through the air bleed line 90 and a blocked state where the hydraulic oil from the relief valve 40 is blocked from flowing to the tank 21 through the air bleed line 90. The air bleed switching valve 63 is disposed on the air bleed line 90.

The air bleed switching valve 63 has a pilot port. In a state where a pilot pressure is not applied to the pilot port, the air bleed switching valve 63 opens to allow the hydraulic oil from the relief valve 40 to flow to the tank 21 through the air bleed line 90, and enters the allowed state. On the other hand, the air bleed switching valve 63 is brought into the blocked state with a predetermined pilot pressure being applied to the pilot port, and blocks the hydraulic oil from the relief valve 40 from flowing to the tank 21 through the air bleed line 90. The air bleed switching valve 63 changes the opening degree based on the pilot pressure input to the pilot port.

When the lever lock 81 inputs the unlocking signal to the controller 70, the controller 70 inputs a command signal to the solenoid of the lever lock valve 64. As a result, the lever lock valve 64 opens, and the hydraulic oil from the pilot pump 23 is supplied to the pilot port of the air bleed switching valve 63 and the air bleed switching valve 63 is switched to the blocked state. On the other hand, when the lever lock 81 inputs the locking signal to the controller 70, the controller 70 does not input, to the solenoid of the lever lock valve 64, a command signal for communicating the line between the pilot pump 23 and the pilot port of the air bleed switching valve 63. In this case, since the hydraulic oil from the pilot pump 23 is not supplied to the pilot port of the air bleed switching valve 63, the air bleed switching valve 63 enters the allowed state. When the main pump 22 discharges the hydraulic oil, the above-described pressure difference is generated between the pressure in the relief valve 40 and the pressure at the portion 92*b* downstream on the return line 92. As a result, the hydraulic oil containing air building up in the relief valve 40 flows out from the air bleed port 43 of the relief valve 40 to the air bleed line 90, flows toward the tank 21 through the air bleed line 90, and is collected in the tank 21.

In the hydraulic excavator 100 according to the present embodiment, the air building up in the relief valve 40 of the hydraulic circuit can be effectively discharged from the relief valve 40 by using the pressure difference between the pressures of the pump discharge line 91 and the portion 92*b* downstream from the boost check valve 67 on the return line 92. Therefore, regardless of the disposing orientation of the relief valve 40 in the upper slewing body 2, the air building up in the relief valve 40, particularly, the air building up in the pressure adjustment mechanism unit 42 of the relief valve 40 can be effectively discharged from the relief valve. As a result, even in a case where the orientation of the relief valve 40 is restricted by the disposition of the control valve main body, the risk of air building up in the relief valve 40 can be reduced. This heightens the degree of disposition freedom of the control valve unit 30 when the control valve unit 30 is mounted on the upper slewing body 2, thus leading to cost reduction.

Further, in the present embodiment, by setting the air bleed switching valve 63 to the blocked state, the relief valve 40 can be caused to exhibit the function of limiting the pressure of the pump discharge line 91, the function being the original function of the relief valve 40. On the other hand, by setting the air bleed switching valve 63 to the allowed state, the air can be bled from the relief valve 40 at the timing when the air bleed is required. The air bleed of the relief valve 40 is performed, for example, immediately before an operator starts work with the hydraulic excavator 100.

In the present embodiment, in a case where the state of the hydraulic circuit is switched from the locked state to the unlocked state, the controller 70 outputs a command signal for switching the air bleed switching valve 63 from the allowed state to the blocked state. Therefore, the air bleed of the relief valve 40 can be performed in the locked state, and the pressure of the pump discharge line 91 can be limited by the relief valve 40 in response to the switching from the locked state to the unlocked state.

Figure 4:
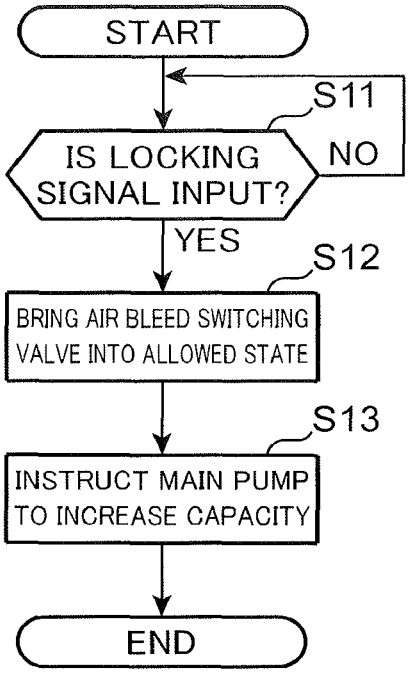
FIG. 4 is a flowchart illustrating an example of an arithmetic control operation by a controller of the construction machine.

In the present embodiment, the controller 70 may output a tilt indicator current which is a command signal for increasing the capacity of the main pump 22 when the air bleed switching valve 63 is in the allowed state. Specifically, when the lever lock 81 inputs the locking signal to the controller 70 (YES in step S11 in FIG. 4), the controller 70 does not input, to the solenoid of the lever lock valve 64, a command signal for communicating the line between the pilot pump 23 and the pilot port of the air bleed switching valve 63, thereby bringing the air bleed switching valve 63 into the allowed state (step S12 in FIG. 4). Further, the controller 70 outputs, for example, a preset tilt indicator current to the main pump 22 until a preset time elapses, thereby maintaining a state where the capacity of the main pump 22 increases (step S13 in FIG. 4). The preset time is set to, for example, a time longer than a time required for completing the air bleed in the relief valve 40. Since the pressure difference is increased by increasing the capacity of the main pump 22 when the air bleed in the relief valve 40 is performed in this manner, the air bleed in the relief valve 40 can be performed in a shorter time.

When the hydraulic circuit is in the locked state, even if the air of the relief valve 40 is not sufficiently bled, for example, an automatic load operation, described later, may be automatically started. In each automatic load operation, the controller 70 performs control so that the hydraulic oil is discharged from the main pump 22 and the unloading valve 50 closes when the hydraulic circuit is in the locked state. Normally, the unloading valve 50 opens during non-operation and closes during the automatic load operation. In this case, when the automatic load operation is started in a state where the air bleed in the relief valve 40 is insufficient, a defect such as generation of an abnormal noise may occur in the relief valve 40.

In the present embodiment, when the hydraulic circuit is in the locked state, the controller 70 outputs a command signal for opening the unloading valve 50 to the unloading electromagnetic proportional valve 51. As a result, since the unloading valve 50 opens when the hydraulic circuit is in the locked state, the generation of an abnormal noise in the relief valve 40 can be avoided even if the automatic load operation is automatically started. Examples of the automatic load control include a warming-up operation at start of the engine, a deposited soot burning operation for burning deposited soot of a diesel particulate filter (DPF), and the like.

Figure 5:
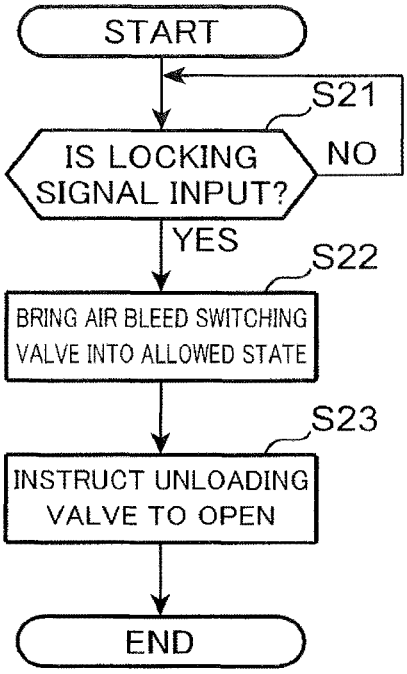
FIG. 5 is a flowchart illustrating another example of the arithmetic control operation performed by the controller of the construction machine.

Specifically, when the lever lock 81 inputs a locking signal to the controller 70 after the start of the engine (specifically, for example, immediately after the start of the engine) (YES in step S21 in FIG. 5), the controller 70 does not input, to the solenoid of the lever lock valve 64, the command signal for communicating the line between the pilot pump 23 and the pilot port of the air bleed switching valve 63, thereby causing the air bleed switching valve 63 to be in the allowed state (step S22 in FIG. 5), and outputs the indicator current for opening the unloading valve 50 to the unloading electromagnetic proportional valve 51 until a preset time elapses (step S23 in FIG. 5). The preset time is set in advance to a time longer than a time required for completing the air bleed in the relief valve. The indicator current may be, for example, a value at which the opening of the unloading valve 50 is maximum. In such a manner, since the unloading valve 50 opens when the hydraulic circuit is in the locked state, the generation of an abnormal noise in the relief valve 40 can be avoided even if the automatic load operation is automatically started.

Figure 3:
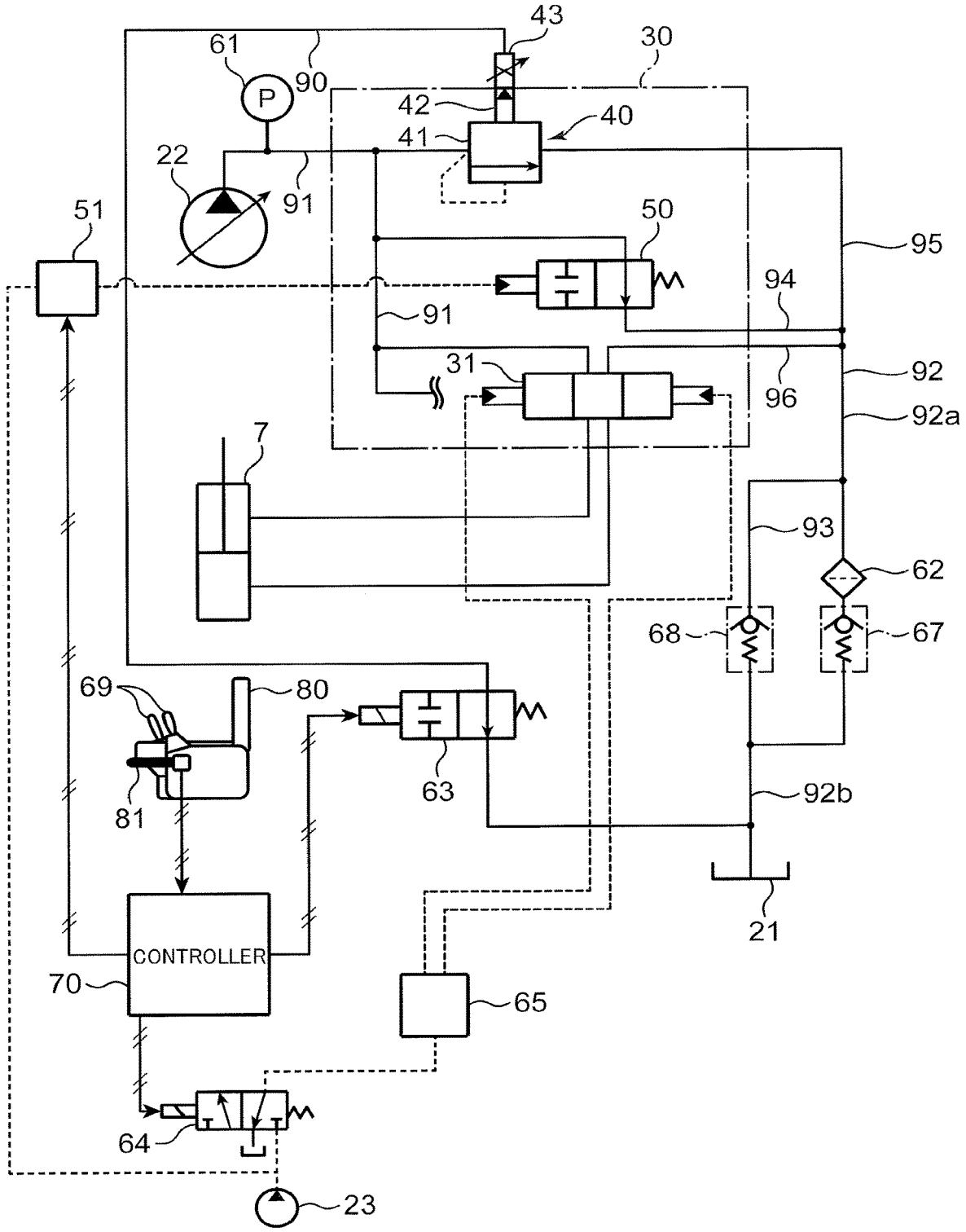
FIG. 3 is a diagram illustrating a hydraulic circuit of the construction machine according to a first modification of the embodiment and devices related thereto.

FIG. 3 is a diagram illustrating the hydraulic circuit of the hydraulic excavator 100 according to a first modification of the present embodiment and devices related thereto. The hydraulic circuit of the hydraulic excavator 100 according to the first modification is different from the hydraulic circuit illustrated in FIG. 2 in further including a pressure sensor 61 and in that the air bleed switching valve 63 is an electromagnetic switching valve, and the other parts are the same as those of the hydraulic circuit illustrated in FIG. 2.

The pressure sensor 61 detects a discharge pressure of the main pump 22 and inputs a detection signal corresponding to the detected pressure to the controller 70. The pressure sensor 61 is disposed, for example, on the pump discharge line 91 between the main pump 22 and the control valve main body.

Figure 6:
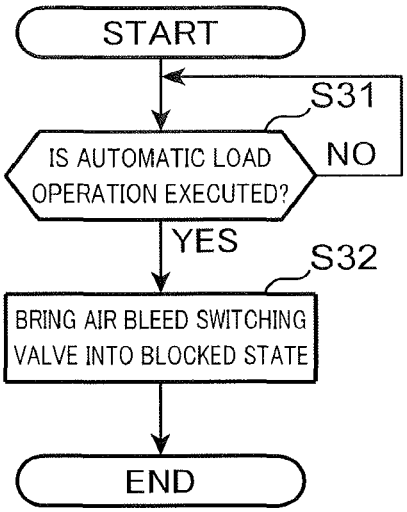
FIG. 6 is a flowchart illustrating still another example of the arithmetic control operation performed by the controller of the construction machine.

In a case where executing the automatic load operation involving discharging the hydraulic oil from the main pump 22 when the hydraulic circuit is in the locked state (YES in step S31 in FIG. 6), the controller 70 outputs a blocking signal, which is a command signal for switching the air bleed switching valve 63 to the blocked state, to the air bleed switching valve 63 (step S32 in FIG. 6). In the automatic load operation, it is necessary to cause the relief valve 40 to exhibit a function of limiting the pressure of the pump discharge line 91, the function being an original function of the relief valve 40. In the present embodiment, in a case where executing the automatic load operation, the controller 70 outputs, to the air bleed switching valve, the blocking signal which is the command signal for switching the air bleed switching valve 63 to the blocked state. Therefore, even in a case where the hydraulic circuit is in the locked state, the automatic load operation can be securely executed.

Specifically, in the present embodiment, the controller 70 outputs the blocking signal to the air bleed switching valve 63 in a case where the pressure detected by the pressure sensor 61 exceeds a predetermined threshold. When the automatic load operation is started, the hydraulic oil is discharged from the main pump 22, and thus the pressure of the pump discharge line 91 rises. Therefore, the increase in the pressure of the pump discharge line 91 at the time when the hydraulic circuit is in the locked state can be an index indicating that the automatic load operation has been started. Therefore, in the present embodiment, the controller 70 outputs the blocking signal to the air bleed switching valve 63 when the pressure of the pump discharge line 91, the pressure being detected by the pressure sensor 61, exceeds the threshold, and thus the relief valve can exhibit the function of limiting the pressure of the pump discharge line 91 in the automatic load operation.

Modifications

The construction machine according to the embodiment of the present disclosure has been described above, but the present disclosure is not limited to the embodiment, and includes the following modifications, for example.

(A) Regarding Construction Machine

In the above embodiment, the construction machine is the hydraulic excavator 100, but may be another construction machine such as a crane or a bulldozer.

(B) Regarding Control Valve Unit

The control valve unit 30 includes the control valve main body, the relief valve 40, and the unloading valve 50, but at least one of the relief valve 40 and the unloading valve 50 may not be mounted on the control valve main body.

(C) Regarding Locking Mechanism (Locking Switch)

In the above embodiment, the locking mechanism (locking switch) is the lever lock 81, but may be another mechanism (another switch) to which an operation performed by an operator can be input. An example of another mechanism (another switch) includes a switch that can receive an operator's input. In this case, the air bleed switching valve is configured to switch between the allowed state and the blocked state in response to an input operation given by an operator to the switch as the locking mechanism (locking switch).

(D) Regarding Back Pressure Generation Mechanism (Back Pressure Generator)

In the above embodiment, the check valve is used as the back pressure generation mechanism (back pressure generator), but the back pressure generation mechanism (back pressure generator) may be a relief valve or a throttle.

According to the present disclosure, provided is a construction machine capable of effectively discharging air building up in a relief valve of a hydraulic circuit from the relief valve.

A construction machine to be provided includes a tank that stores hydraulic oil, a main pump that is a hydraulic pump that discharges the hydraulic oil sucked from the tank, a hydraulic actuator that receives supply of the hydraulic oil from the main pump to operate, a direction switching valve that controls supply and discharge of the hydraulic oil between the main pump and the hydraulic actuator, a relief valve that opens to limit a pressure of a pump discharge line that is a line between the main pump and the direction switching valve, a back pressure generation mechanism that is disposed on a return line as a line connected to the tank and generates a back pressure in the return line, and an air bleed line that connects the relief valve and a portion downstream from the back pressure generation mechanism in the return line.

In this construction machine, air building up in the relief valve of the hydraulic circuit can be effectively discharged from the relief valve by using the pressure difference between the pressures of the pump discharge line and the portion downstream from the back pressure generation mechanism in the return line. Specifically, air is likely to build up in the relief valve depending on the mounting orientation of the relief valve onto a machine body such as the upper slewing body. In this configuration, the air building up in the relief valve of the hydraulic circuit can be effectively discharged from the relief valve regardless of the orientation of the relief valve. Therefore, even in a case where the orientation of the relief valve is determined by a factor other than the relief valve, the risk of air building up in the relief valve can be reduced.

The construction machine preferably further includes an air bleed switching valve capable of switching between an allowed state where the hydraulic oil from the relief valve is allowed to flow to the tank through the air bleed line and a blocked state where the hydraulic oil from the relief valve is blocked from flowing to the tank through the air bleed line. In this configuration, by setting the air bleed switching valve to the blocked state, the relief valve can be caused to exhibit the function of limiting the pressure of the pump discharge line, the function being the original function of the relief valve. On the other hand, by setting the air bleed switching valve to the allowed state, the air can be bled from the relief valve at the timing when the air bleed is required. Specifically, air bleed of the relief valve is preferably performed, for example, immediately before the operator starts work using the construction machine.

Preferably, the construction machine further includes an operation lever to which an operation for operating the hydraulic actuator is given, a locking mechanism that receives an operation for switching a state of a hydraulic circuit between an unlocked state where the hydraulic actuator is permitted to operate in response to the operation given to the operation lever and a locked state where the hydraulic actuator is prevented from operating in response to the operation given to the operation lever, and a controller. The controller outputs a command signal for switching the air bleed switching valve from the allowed state to the blocked state in a case where the state of the hydraulic circuit is switched from the locked state to the unlocked state. In this configuration, the air bleed in the relief valve can be performed in the locked state, and the pressure of the pump discharge line can be limited by the relief valve in response to the switching from the locked state to the unlocked state.

The main pump is a variable displacement type hydraulic pump, and the controller outputs a command signal for increasing a capacity of the main pump when the air bleed switching valve is in the allowed state. In this configuration, since the pressure difference is increased by increasing the capacity of the main pump when the air bleed of the relief valve is performed, the air bleed in the relief valve can be performed in a shorter time.

The air bleed switching valve is an electromagnetic switching valve, and the controller outputs, to the air bleed switching valve, a blocking signal that is a command signal for switching the air bleed switching valve to the blocked state, in a case where an automatic load operation involving discharging the hydraulic oil from the main pump is executed when the hydraulic circuit is in the locked state. In the construction machine, the controller may execute the automatic load operation such as a warming-up operation at start of an engine, and a deposited soot burning operation for burning deposited soot of a diesel particulate filter (DPF). In each automatic load operation, the controller performs control so that the hydraulic oil is discharged from the main pump when the hydraulic circuit is in the locked state. In the automatic load operation, it is necessary to cause the relief valve to exhibit a function of limiting the pressure of the pump discharge line, the function being an original function of the relief valve. In this configuration, in a case where executing the automatic load operation, the controller outputs, to the air bleed switching valve, the blocking signal that is the command signal for switching the air bleed switching valve to the blocked state. Therefore, even in a case where the hydraulic circuit is in the locked state, the automatic load operation can be securely executed.

Preferably, the construction machine further includes a pressure sensor that detects a pressure of the pump discharge line, and the controller outputs the blocking signal to the air bleed switching valve in a case where the pressure detected by the pressure sensor exceeds a predetermined threshold. When the automatic load operation is started, the hydraulic oil is discharged from the main pump, and thus the pressure of the pump discharge line rises. Therefore, the increase in the pressure of the pump discharge line at the time when the hydraulic circuit is in the locked state can be an index indicating that the automatic load operation has been started. Therefore, in the this configuration, the controller outputs the blocking signal to the air bleed switching valve when the pressure of the pump discharge line, the pressure being detected by the pressure sensor, exceeds the threshold, thereby causing the relief valve to exhibit the function of limiting the pressure of the pump discharge line in the automatic load operation.

The construction machine further includes an unloading valve that opens to allow the hydraulic oil discharged from the main pump to flow to the return line without supply to the hydraulic actuator, and the controller outputs a command signal for opening the unloading valve when the hydraulic circuit is in the locked state. When the hydraulic circuit is in the locked state, even if the air in the relief valve is not sufficiently bled, for example, the automatic load operation may be automatically started. Normally, the unloading valve opens during non-operation, that is, when the operation lever is not operated, and closes during the automatic load operation. In this case, when the automatic load operation is started in a state where the air bleed in the relief valve is insufficient, a defect such as generation of an abnormal noise may occur in the relief valve. In this configuration, even if the automatic load operation is automatically started when the hydraulic circuit is in the locked state, the opening of the unloading valve is forcibly held, thus making it possible to avoid generation of an abnormal noise in the relief valve. More preferably, when the hydraulic circuit is in the locked state, the controller outputs a command signal for maintaining the unloading valve in the opened state until a predetermined time elapses. In this case, the predetermined time is preferably set to be longer than the time required for completing the air bleed in the relief valve.

The invention claimed is:

1. A construction machine, comprising:

a tank that stores hydraulic oil;

a main pump that is a hydraulic pump that discharges the hydraulic oil sucked from the tank;

a hydraulic actuator that receives supply of the hydraulic oil from the main pump to operate;

a direction switching valve that controls supply and discharge of the hydraulic oil between the main pump and the hydraulic actuator;

a relief valve that opens to limit a pressure of a pump discharge line that is a line between the main pump and the direction switching valve;

a back pressure generation mechanism that is disposed on a return line as a line connected to the tank and generates a back pressure in the return line; and an air bleed line that connects the relief valve and a portion downstream from the back pressure generation mechanism on the return line, wherein the relief valve includes:

a first port connected to a first line connecting the relief valve and the main pump:

a second port connected to a second line connecting the relief valve and the tank; and an air bleed port connected to an upstream end of the air bleed line.

2. The construction machine according to claim 1, further comprising an air bleed switching valve capable of switching between an allowed state where the hydraulic oil from the relief valve is allowed to flow to the tank through the air bleed line and a blocked state where the hydraulic oil from the relief valve is blocked from flowing to the tank through the air bleed line.

3. The construction machine according to claim 2, further comprising:

an operation lever to which an operation for operating the hydraulic actuator is given;

a locking mechanism that receives an operation for switching a state of a hydraulic circuit between an unlocked state where the hydraulic actuator is permitted to operate in response to the operation given to the operation lever and a locked state where the hydraulic actuator is prevented from operating in response to the operation given to the operation lever; and a controller, wherein the controller outputs a command signal for switching the air bleed switching valve from the allowed state to the blocked state in a case where the state of the hydraulic circuit is switched from the locked state to the unlocked state.

4. The construction machine according to claim 3, wherein the main pump is a variable displacement type hydraulic pump, and the controller outputs a command signal for increasing a capacity of the main pump when the air bleed switching valve is in the allowed state.

5. The construction machine according to claim 3, wherein the air bleed switching valve is an electromagnetic switching valve, and the controller outputs, to the air bleed switching valve, a blocking signal that is a command signal for switching the air bleed switching valve to the blocked state, in a case where an automatic load operation involving discharging the hydraulic oil from the main pump is executed when the hydraulic circuit is in the locked state.

6. The construction machine according to claim 5, further comprising a pressure sensor that detects a pressure of the pump discharge line, wherein the controller outputs the blocking signal to the air bleed switching valve in a case where the pressure detected by the pressure sensor exceeds a predetermined threshold.

7. The construction machine according to claim 3, further comprising an unloading valve that opens to allow the hydraulic oil discharged from the main pump to flow to the return line without supply to the hydraulic actuator, wherein the controller outputs a command signal for opening the unloading valve when the hydraulic circuit is in the locked state.

* * * * *